United States Patent [19]

Weber

[11] Patent Number: 4,989,666

[45] Date of Patent: Feb. 5, 1991

[54] PROCESS AND DEVICE FOR ELECTROMAGNETICALLY CASTING METALS

[75] Inventor: Jean-Claude Weber, Sierre, Switzerland

[73] Assignee: Swiss Aluminium Ltd., Chippis, Switzerland

[21] Appl. No.: 435,334

[22] Filed: Nov. 13, 1989

[30] Foreign Application Priority Data

Dec. 22, 1988 [CH] Switzerland ..... 4752/88

[51] Int. Cl.[5] ..... B22D 27/02

[52] U.S. Cl. ..... 164/467; 164/459; 164/503

[58] Field of Search ..... 164/467, 503, 459, 418, 164/485, 486, 487, 443, 444, 439, 488

[56] References Cited

U.S. PATENT DOCUMENTS 4,612,972 9/1986 Dantzig ..... 164/467

*Primary Examiner*—Kuang Y. Lin

*Attorney, Agent, or Firm*—Bachman & La Pointe

[57] ABSTRACT

In a process for electromagnetic casting of round and hollow ingots, in particular such of aluminum and aluminum alloys, the ingot (7) is rotated about its longitudinal axis (x) during casting. This is achieved by way of a rotatable dummy base (6). With that the metal feed and cooling of the ingot is made symmetrical and, as a result, a more uniform shape is obtained and a more uniform cell structure across the ingot cross-section. In order to promote a stronger stirring effect, a stationary stirrer (8) dipping into the molten part of the ingot (7) can be provided attached to the metal inlet system (3).

16 Claims, 2 Drawing Sheets

PROCESS AND DEVICE FOR ELECTROMAGNETICALLY CASTING METALS

BACKGROUND OF THE INVENTION

The invention relates to a process for vertical electromagnetic casting of round and hollow ingots, in particular of aluminum and aluminum alloys. Also within the scope of the invention is a device for carrying out the process.

An unfavorable metal feeding system and non-uniform water spray cooling often lead to inferior quality in cast products. The result is for example a non-uniform cell structure or even scrap due to cold/hot cracks which in extreme cases can lead to the casting being interrupted. The negative effect of the metal feed system and water spray cooling on the quality of the ingot to be cast increases further with lower rates of casting; this is especially the case when casting large format extrusion ingots.

In view of the above the object of the invention is to develop a process and suitable device by means of which more uniform metal feed and cooling can be achieved.

SUMMARY OF THE INVENTION

With reference to the process the object is achieved by way of the invention in that the ingot is rotated about its longitudinal axis during the casting operation. As a result metal feeding and the cooling of the ingot becomes symmetrical. The process according to the invention is, consequently, suitable for electromagnetic casting of large format ingots. Furthermore the geometric tolerances for these cast products are also better. In addition, the cell structure in ingots cast according to the invention is more uniform over the ingot cross-section.

The speed of rotation of the dummy base is preferably in the range 0.1–200 Herz. As such, the speed of rotation depends on the application and the ingot format. Low-to-moderate speeds of rotation are employed when constant shape, uniform cooling of the ingot and a uniform cell structure is aimed at. Moderate-to-high speeds of rotation are suitable in particular also for the introduction of additions such as, for example, SiC fibers.

Furthermore the liquid part of the ingot can be stirred with a stationary stirrer attached to the metal feeding system.

With respect to the device the object is achieved by way of the invention by means of an electromagnetic mold with metal-feed system and dummy base, the latter being such that it can be rotated about the longitudinal axis of the ingot.

As a result of the simple rotational movement of the dummy base a consistancy of shape and uniform cooling of the ingot is achieved. In order to increase the stirring action a stationary stirrer immersed in the molten part of the ingot can be attached to the metal feed system.

Suitable as stirrer is any kind of baffle immersed in the molten part of the ingot and lying transverse to the direction of rotational flow of the metal. A stirrer can for example be in the form of a circular cog-like plate.

Another version is such that the stirrer comprises at least one plate lying vertical and symmetrical to the longitudinal axis of the ingot.

Another possibility is to design the stirrer such that it is similar to a ship's propeller with the axis of the propellor lying in the longitudinal direction of the ingot.

BRIEF DESCRIPTION OF THE DRAWINGS

Further advantages, features and details of the invention are revealed in the following description of preferred shapes and with the aid of the drawings.

DETAILED DESCRIPTION

Figure 1:
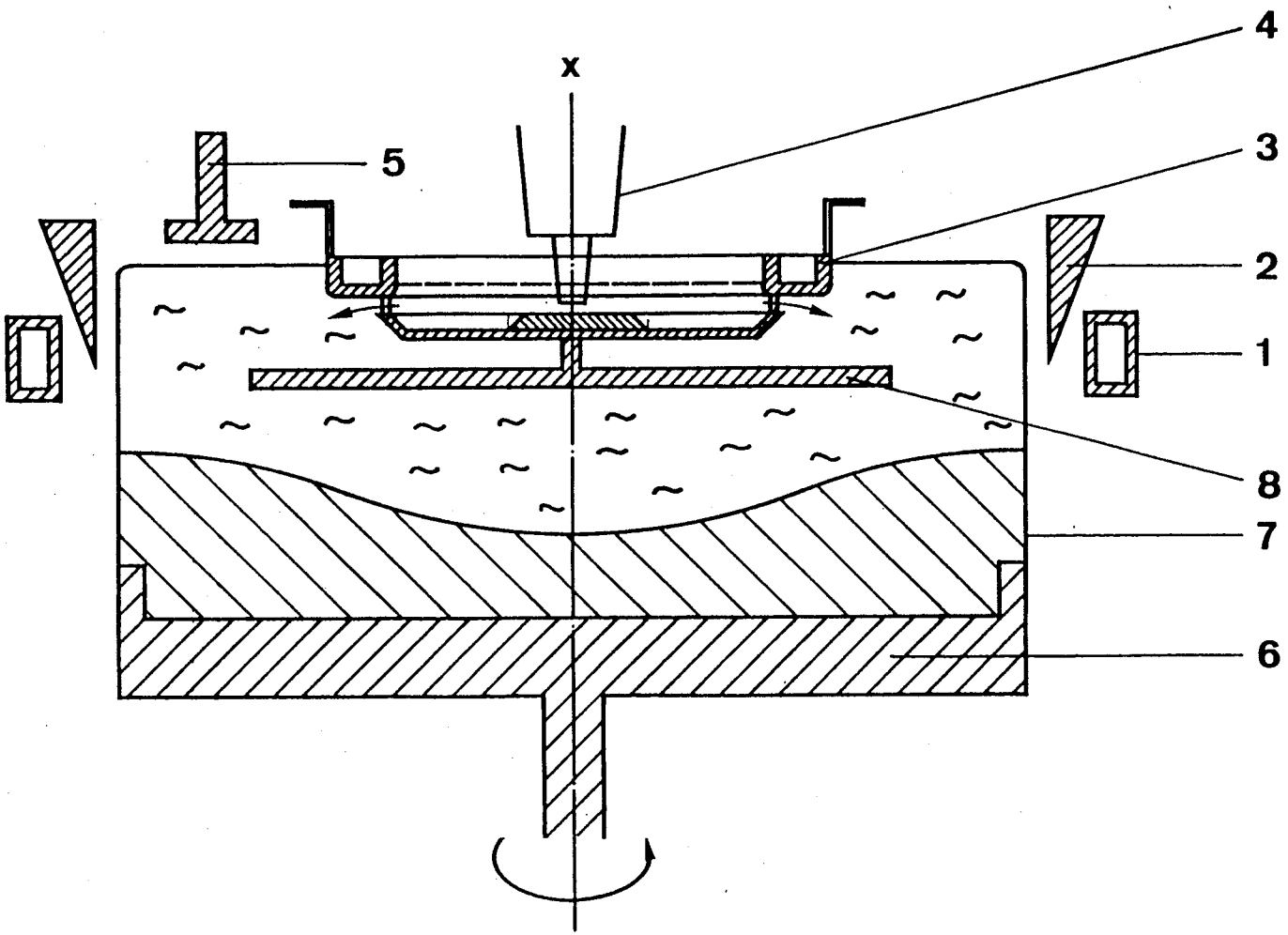
FIG. 1 shows a cross-section through a device according to the invention

An electromagnetic continuous casting unit comprises, as in FIG. 1, essentially of an inductor 1, a screen 2, a means of cooling with sprayed water which is not shown here, a metal inlet system or float 3, a nozzle 4 for metal feed, a level sensor 5 for regulating the level of metal in the mold and a dummy base 6. Attached to the float 3 is a stationary stirrer 8 immersed in the molten part of the ingot 7. The stirring effect is achieved by rotation of the dummy base 6 which can be rotated about the ingot axis x. The stirrer 8 features some kind of baffle that lies perpendicular to the direction of metal flow in the molten part of the ingot 7, the flow being effected by the above mentioned rotation.

Figure 2:
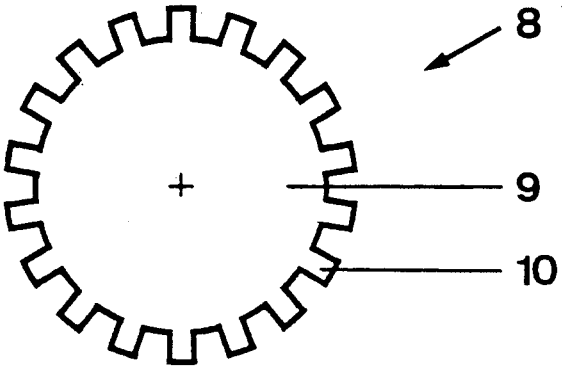
FIG. 2 shows a plan view of a stirrer according to the invention

The stirrer 8 in FIG. 2 is shown as a circular plate 9 having teeth 10.

Figure 3:
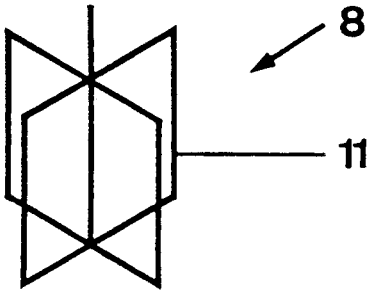
FIG. 3 shows a perspective view of another stirrer according to the invention

In FIG. 3 the stirrer 8 comprises two vertical plates 11 arranged symmetrical with respect to the longitudinal axis x of the ingot.

Figure 4:
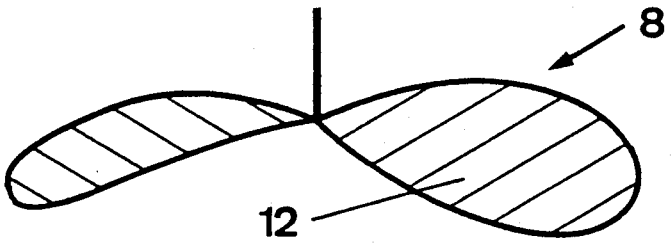
FIG. 4 shows a perspective view of a further stirrer according to the invention

The stirrer 8 shown in FIG. 4 has the form of a ship's propeller with two propellor blades 12. The propeller axis coincides with the longitudinal axis x of the ingot 7.

I claim:

1. A process for vertically electromagnetically casting metal ingots which comprises the steps of:

providing an inductor to form an electromagnetic casting zone about the surface of molten metal;

introducing molten metal into said casting zone and forming a symmetrical ingot shape from said molten metal, wherein said ingot has a longitudinal axis which is the axis of symmetry of said ingot; and rotating the molten metal in said casting zone around the longitudinal axis during casting thereof thereby stirring the molten metal during casting step so as to provide a uniform cell structure over the final ingot cross-section symmetrical to the axis of rotation.

2. Process according to claim 1 wherein the ingot is round.

3. Process according to claim 2 wherein the ingot rotates at a speed of 0.1 to 200 revolutions per second.

4. Process according to claim 1 including the step of stirring the molten part of the ingot by means of a stationary stirrer.

5. A process for vertically electromagnetically casting metal ingots which comprises the steps of:

providing an inductor to form an electromagnetic casting zone about the surface of molten metal;

introducing molten metal into said casting zone and forming the desired ingot shape from said molten metal; and stirring the molten part of said ingot by means of a stirrer located in the molten part of said ingot.

6. Process according to claim 5 including the steps of:

providing a molten metal inlet system;

providing a dummy base for said ingot; and rotating the ingot about its longitudinal axis at a speed of 0.1 to 200 revolutions per second.

7. Process according to claim 6 including the step of attaching a stationary stirrer to the metal inlet system and dipping the stirrer into the molten part of the ingot.

8. Process according to claim 7 wherein said stirrer has a shape selected from the group consisting of (1) a circular plate with teeth, (2) at least one vertical plate arranged symmetrical to the longitudinal axis of the ingot, and (3) a ship's propeller with an axis coinciding with the longitudinal axis of the ingot.

9. Apparatus for vertically electromagnetically casting metal ingots having a longitudinal axis which comprises:

an inductor to form an electromagnetic casting zone about the surface of molten metal;

a molten metal inlet system to introduce molten metal into said casting zone;

a dummy base for the ingot spaced from said metal inlet system; and a stirrer located in the molten portion of said ingot in said casting zone.

10. Apparatus according to claim 9 including a non-magnetic screen spaced from the metal inlet system.

11. Apparatus according to claim 9 wherein the stirrer is attached to the metal inlet system.

12. Apparatus according to claim 11 wherein the stirrer comprises a circular plate with teeth.

13. Apparatus according to claim 11 wherein the stirrer comprises at least one vertical plate arranged symmetrical to the longitudinal axis of the ingot.

14. Apparatus according to claim 11 wherein the stirrer is in the form of a ship's propeller with an axis coinciding with the longitudinal axis of the ingot.

15. Apparatus according to claim 9 including means to rotate said dummy base with respect to the longitudinal axis of said ingot.

16. Apparatus according to claim 9 including means to deliver coolant to the surface of said molten metal.

* * * * *